US006460577B1

(12) United States Patent
Krumm

(10) Patent No.: US 6,460,577 B1
(45) Date of Patent: Oct. 8, 2002

(54) ELECTRIC MOTOR DRIVE MECHANISM FOR SHED FORMING COMPONENTS OF A LOOM

(75) Inventor: Valentin Krumm, Hergensweiler (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 10/093,671

(22) Filed: Mar. 7, 2002

(30) Foreign Application Priority Data

Mar. 7, 2001 (DE) ..... 101 11 017

(51) Int. Cl.[7] ..... D03D 41/00; D03D 47/18; D03C 13/00

(52) U.S. Cl. ..... 139/57; 139/55.1; 139/455

(58) Field of Search ..... 139/55.1, 455, 139/456, 57

(56) References Cited

U.S. PATENT DOCUMENTS 5,740,840 A * 4/1998 Lindahl ..... 139/55.1
5,743,305 A * 4/1998 Tamura et al. ..... 139/1 E

FOREIGN PATENT DOCUMENTS

| | | |
|---|---|---|
| DE | 19651799 | 6/1998 |
| DE | 19821094 | 7/1999 |
| DE | 19849728 | 5/2000 |
| EP | 0825285 | 2/1998 |
| EP | 0879990 | 11/1998 |
| JP | 07324247 | 12/1995 |
| JP | 09078389 | 3/1997 |
| JP | 10310947 | 11/1998 |
| JP | 10310948 | 11/1998 |
| JP | 10310949 | 11/1998 |
| JP | 11124751 | 5/1999 |
| JP | 11286850 | 10/1999 |
| JP | 11350285 | 12/1999 |

* cited by examiner

*Primary Examiner*—Andy Falik
(74) *Attorney, Agent, or Firm*—W. F. Fasse; W. G. Fasse

(57) ABSTRACT

The heald shafts of a power loom are driven by electric D.C. or A.C. motors which have an external rotor or an armature connected to the respective heald shaft through two articulated couplings, for example snap locks, and a push-pull rod. The motors receive control signals from a computerized controller for reversing the motion direction of the external rotor or armature. The stators of the motors are rigidly mounted on a fixed axis secured to the loom frame.

20 Claims, 7 Drawing Sheets

ELECTRIC MOTOR DRIVE MECHANISM FOR SHED FORMING COMPONENTS OF A LOOM

PRIORITY CLAIM

This application is based on and claims the priority under 35 U.S.C. §119 of German Patent Application No. 101 11 017.0, filed on Mar. 7, 2001 in Federal Republic of Germany, the entire disclosure of which is incorporated herein by reference.

FIELD OF THE INVENTION

A power loom has shed forming components such as the heald frames or heald shafts which are operated by electric motors for opening and closing the loom shed in a controlled sequence.

BACKGROUND INFORMATION

Drive mechanisms for operating the heald shafts of weaving looms which are not so-called shaft looms or so-called eccentric drive looms are known. These known drive mechanisms can be categorized primarily into two categories. One category includes rotational D.C. motor drives. Another category includes so-called linear D.C. motor drives. The first category of the rotational D.C. motor drives includes motors which are operated to repeatedly reverse their rotational direction, for example in an oscillating manner in order to transmit the oscillating reversing motion through so-called detour levers and linkages into an oscillating linear motion of the loom shed forming components.

Further distinctions in the type of drive can be made between so-called direct drives and drives which are connected with the shed forming components through so-called bottom or lower heald frame motions. German Patent Publication DE 196 51 799 A1 discloses such a drive with a lower heald frame motion. Similarly, Japanese Patent Publication JP 07-324247A discloses such a drive with a lower heald frame motion.

Japanese Patent Publication JP 11-124751A discloses a drive for loom shed forming components including a shaft lower heald frame motion wherein the rotational motion of the drive is transmitted to the shaft lower heald frame motion through gear elements and an eccentrically mounted single arm lever. The shaft lower heald frame motion includes a detour lever and a push-pull rod, whereby the rotational motion is converted for each heald shaft into a stroke motion which changes its direction repeatedly.

Japanese Patent Publication JP 11-350285 discloses a drive for the shed forming components of a loom. That drive includes a rotor and a stator of an external armature motor that is electrically controllable. The rotor of such an external armature motor comprises gear teeth around its external circumference. These gear teeth mesh with longitudinal struts of the heald shafts. These struts are formed as toothed racks. No bottom or lower heald frame motions are required for the shed forming components.

The above mentioned German Patent Publication DE 196 51 799 A1 discloses a similar drive as the Japanese Patent Publication JP 11-350285, however in the German disclosure a bottom or lower heald frame motion is required. A disadvantage of that structure is seen in that the loom must be equipped with special shed forming components. More specifically, special heald shafts are required or at the very least, the heald shafts must be provided with elements permitting the coupling of the shafts to the drive as disclosed in German Patent Publication DE 196 51 799 A1. As a result, conventional heald shafts cannot be used and the drive disclosed in the German Patent Publication DE 196 51 799 cannot be used for retrofitting existing looms without substantial changes in the heald shafts, or rather in the coupling portion of the heald shafts.

German Patent Publication DE 198 82 094 A1 discloses an electromagnetic drive mechanism that can be used either for directly or for indirectly driving the heald shafts. When the known mechanism is used as an indirect electromagnetic heald shaft drive, the stroke motion of the heald shafts is accomplished through so-called bottom or lower heald frame motion. When the known electromagnetic drive is acting as a direct drive, motion direction changing means such as detour levers are avoided. The known electromagnetic drive is presumably constructed to include coils and coil cores or armatures. However, no details are disclosed in German Patent Publication DE 198 21 094 A1 for the person of ordinary skill in the art how the advantages mentioned are achieved in fact.

Japanese Patent Publication JP 09-078389A discloses a heald shaft drive without a bottom or lower heald frame motion. The known drive comprises an electric motor generating a rotation motion which is converted into an oscillating linear motion by means of a type of crank drive which transmits the linear motion to the respective heald shaft. Such a drive is also further disclosed in Japanese Patent Publication JP 11-286850.

German Patent Publication DE 198 49 728 A1 discloses a drive falling into the category with a D.C. linear motor as the power portion of the drive mechanism for the shed forming components of the loom. The known drive comprises actuators in the form of circular sectors or quasi-rotation D.C. motors with a common magnetic stator provided for several or all actuators or rather for the magnetic stator flow of several or all actuators. This magnetic stator flow is generated by permanent magnets. Each of these permanent magnets is divided into at least two oppositely polarized sectors and these sectors in turn are mounted in a non-magnetic carrier with a spacing between neighboring permanent magnets. These permanent magnets are spaced from one another by an air gap. A motion transmission element is installed in the air gap. The motion transmission element includes a carrier made of a non-magnetic, electrically non-conducting material. The motion transmission element further includes at least one thin coil. The transmission or transformation of the motion from the motion transmission element to the working or driven element is preferably accomplished by a linking member. A position sensor allocated to each actuator serves as a position pick-up or position indicator. The drive mechanism between the motion transmission member of the linear D.C. motor and the respective shed forming component also requires a special heald shaft or at least suitable modifications for the heald shaft for the interconnection so that the required heald shafts do not correspond to conventional heald shafts and retrofitting is not possible without substantial effort and expense.

The Japanese Patent Publications JP 10-310947A, JP 10-310948A, and JP 10-310949A disclose further linear D.C. motors as drives for the shed forming components of a loom. For each of these conventional drives it is required that special heald shafts are provided since these drives are arranged in the heald frame of the respective heald shaft. The foregoing conventional technical solutions of the problem how to drive heald shafts in a loom have the disadvantage that it is necessary to lift the shaft packet with the armature of the linear D.C. motor out of the loom when it becomes necessary to exchange the heald shaft, for example when the fabric type is to be changed or when shaft repairs are necessary. The reinsertion of the shaft packet into the loom may damage the shaft drives. Another disadvantage is seen in that it is very easy to damage a shaft when the drive motor has a defect since the respective shaft can jam in its guides. Moreover, such conventional drives are suitable only for relatively narrow looms because a center drive having the same drive conception as a drive that is integrated into the shaft side supports or frame side members is not possible.

Another disadvantage of the drive disclosed in Japanese Patent Publication JP 10-310949 A is seen in that either the heald shafts must have different lengths or shafts having the same length relative to one another must be laterally displaced relative to each other in the weaving loom. Such a shaft arrangement does not permit efficiently carrying out the preparations for weaving. Conventional warp thread drawing-in looms must especially be adapted for these conventional drives. Besides, these conventional drives result in relatively wide looms while achieving a comparatively narrow weaving width.

European Patent Publication EP 0,879,990 A2 discloses a drive for the shed forming components of a weaving loom involving a rocker lever system driven by linear motors. This conventional construction has the disadvantage that the position of the shaft connections from shaft to shaft is different. Thus, it is no longer possible to exchange one individual shaft for another which can be a substantial disadvantage, particularly in maintaining a large stock of spare parts.

European Patent Publication EP 0,825,285 A1 discloses an arrangement of shed forming components which are driven by linear motors. Such a conventional construction requires a super structure and a bottom structure for the mounting of the shed forming components. The drive is accomplished in so-called groups of four so that the heald shafts require differently positioned drive connections, more specifically differently positioned shaft couplings. Here again it is more difficult to carry out the preparations for weaving and the coordination of the heald shafts during a shaft exchange is also difficult. Besides, a super structure is known to provide a certain complexity on the weaving floor. The insertion of the heald shafts into the loom as well as their removal from the loom is not without its own problems as compared to other conventional heald shafts.

OBJECTS OF THE INVENTION

In view of the foregoing it is the aim of the invention to achieve the following objects singly or in combination:

- to provide a drive for loom shed forming components in a loom in such a way that its arrangement in the loom permits the use of conventional heald shafts as shed forming components;
- to provide a heald shaft drive capable of cooperating with conventional rapid action couplings or so-called snap locks between the drive and the heald shafts so that conventional bottom heald shaft motions and detour levers between the shafts and the shaft drives are avoided;
- to avoid the use of crank drives between the drive power source and the shafts; and
- to construct the heald shaft drive in such a manner that it is compatible with any free programming for the drive control to permit different weaves, different weaving pattern repeats, different shaft strokes and different motion profiles of the shafts to be realized, whereby weft yarn parameters should also be taken into account.

SUMMARY OF THE INVENTION

According to the invention there is provided a drive mechanism for shed forming components of a loom, said drive mechanism comprising at lest one modular electric motor for each of said shed forming components, said modular electric motor including a stationary motor section, a movable motor section, and a central axis, a motor control electrically connected to said at least one electric motor for oscillating said movable motor section back and forth in opposite motion directions, a push-pull rod, a first articulated coupling operatively connecting a first end of said push-pull rod to said respective shed forming component of said shed forming components, a second articulated coupling operatively connecting a second end of said push-pull rod to said movable motor section radially outwardly of said central axis and a stationary axle adapted for rigid mounting in a frame of said loom, wherein said stationary motor section of said modular electric motor is rigidly secured to said stationary axle as a modular unit.

An important advantage of the heald shaft drive according to the invention is seen in that it permits any desired motion profiles for the heald shafts with regard to the loom shed opening profile and any desired shed closure as well as any desired shaft strokes. The shed closure can be coordinated to color and/or other parameters of the weft threads as well as the type of weave. The avoidance of bottom or lower heald shaft motions results in a shaft drive that reduces costs as well as materials. Moreover, maintenance and repair time savings are achieved, for example when shaft exchanges must be made. Repair and maintenance work is avoided particularly of bearings that are conventionally integrated into detour levers, since such detour levers are avoided according to the invention. A very important further advantage is seen in that all conventional looms can be retrofitted with the shaft drive according to the invention, because conventional loom heald shafts with conventional shaft couplings can be connected directly to the present drives.

BRIEF DESCRIPTION OF THE DRAWINGS

In order that the invention may be clearly understood, it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
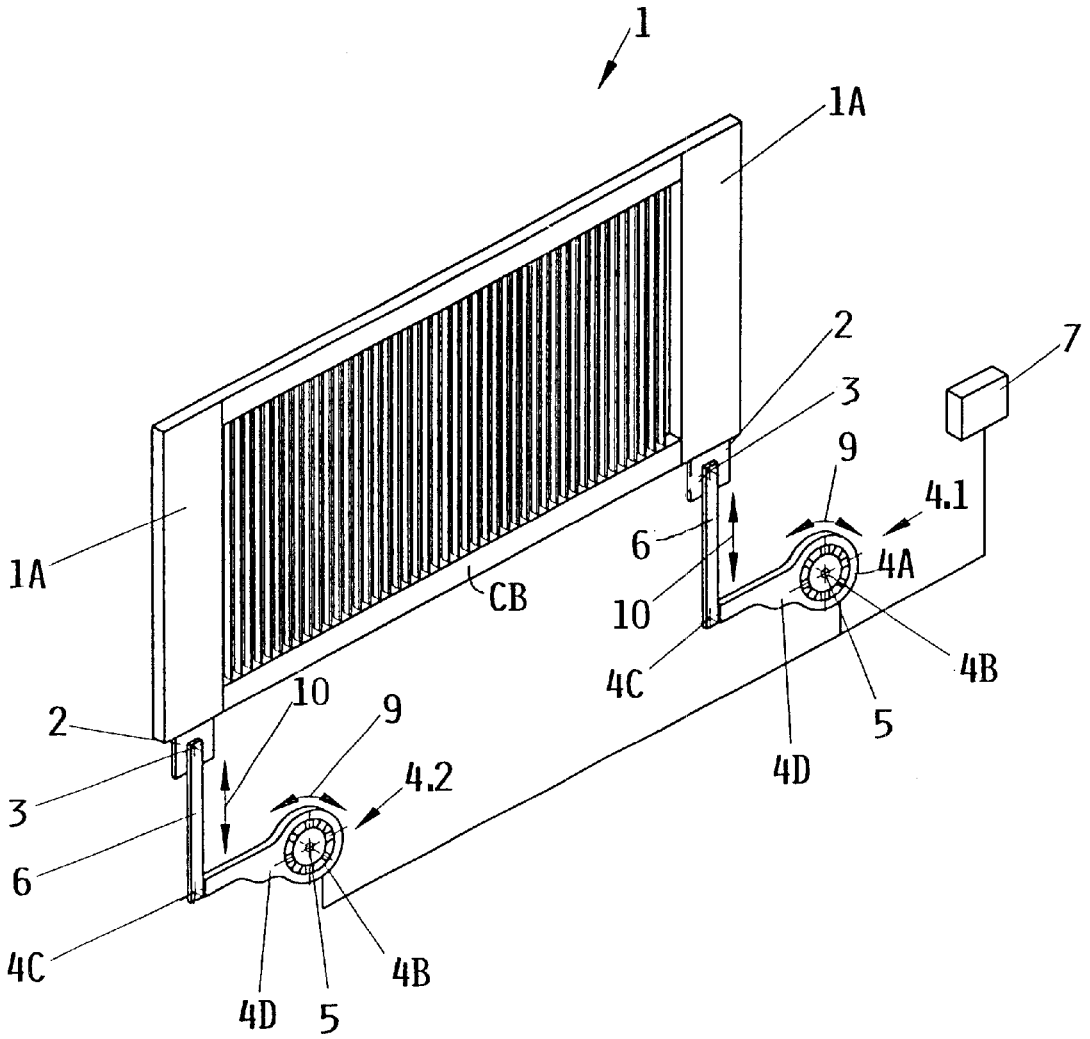
FIG. 1 is a schematic illustration of two electric motor drives operating one heald shaft.

FIG. 1 shows a heald frame 1 having lateral frame sections 1A provided with coupling projections 2. The coupling projections or extensions 2 may be integral parts of the lateral frame sections 1A. The coupling projections 2 form part of a first articulated coupling 3 operatively connecting an upper end of a push-pull rod 6 to the heald frame 1. A second articulated coupling 4C, 11C connects a lower end of the push-pull rod 6 to a drive lever or arm to be described in more detail below. The first and second couplings 3, 4C, 11C or at least the second couplings are preferably so-called quick or rapid action couplings or snap locks which as such are known, for example from German Patent Publication DE 195 48 848 B1.

Although FIG. 1 shows two symmetrically arranged drives 4.1 and 4.2, it is possible to provide but one centrally arranged drive 4.3 which would be centrally coupled to a horizontal crossbeam CB of the heald frame 1. Such a central connection of a single drive 4.3 is particularly suitable for looms having a relatively small weaving width of, for example 1.5 m. A central coupling is, for example, known from the above mentioned Japanese Patent Publication JP 09-078389A. However, according to the invention as shown in FIG. 1 the push-pull rods 6 are not pivotally connected to so-called motion detour levers of so-called bottom heald shaft motions. Rather, according to the invention the lower ends of the push-pull rods 6 are pivoted or articulated or hinged to the above mentioned drive lever or arm 4D of a rotor 4A of modular electric motors 4.1 and 4.2, respectively. These articulated couplings between the push-pull rods 6 and the lever arms 4D are shown at 4C in FIG. 1. Since the modular electric motors 4.1 and 4.2 are reversible in their rotational direction by control signals from a motor control 7 as indicated by the double arrows 9, the push-pull rods 6 are moved up and down as indicated by the double arrows 10. The details of the motor 4 or 4.1, 4.2 will be described below with reference to FIG. 4.

Figure 2:
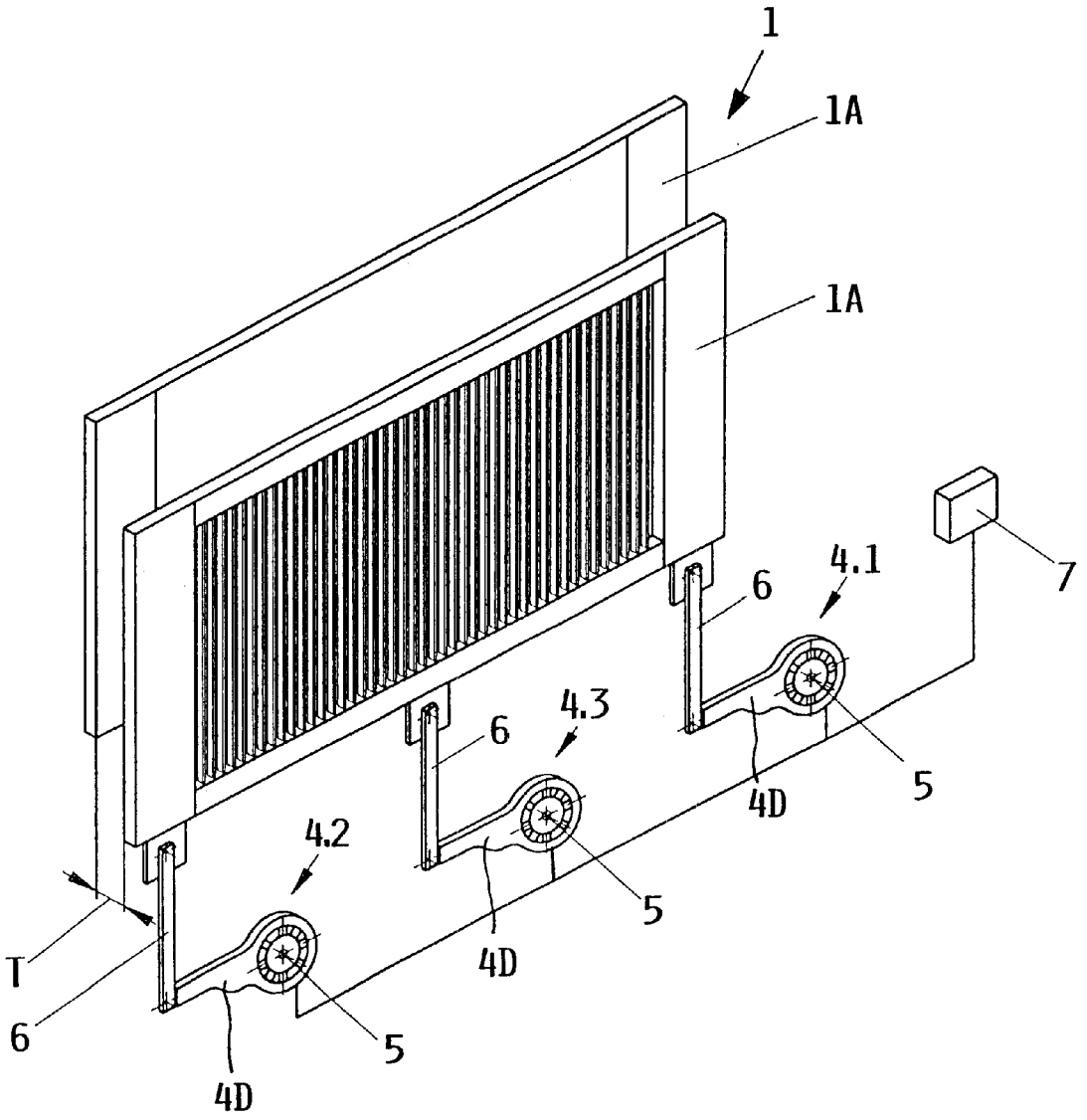
FIG. 2 is a view similar to that of FIG. 2, however, illustrating three electric motor drives connected to one heald shaft.

FIG. 2 illustrates an embodiment according to the invention with three motor drive mechanisms in a loom having shed forming components including at least two heald shafts 1.1 and 1.2. Such a construction is particularly useful for weaving looms having a weaving width of more than, for example 3 m. These motors 4.1, 4.2 and 4.3 are mounted on fixed axles 5.1, 5.2 and 5.3 rigidly secured to a loom frame LF symbolically shown in FIG. 6. The loom frame also carries a central or main loom drive.

Figure 3:
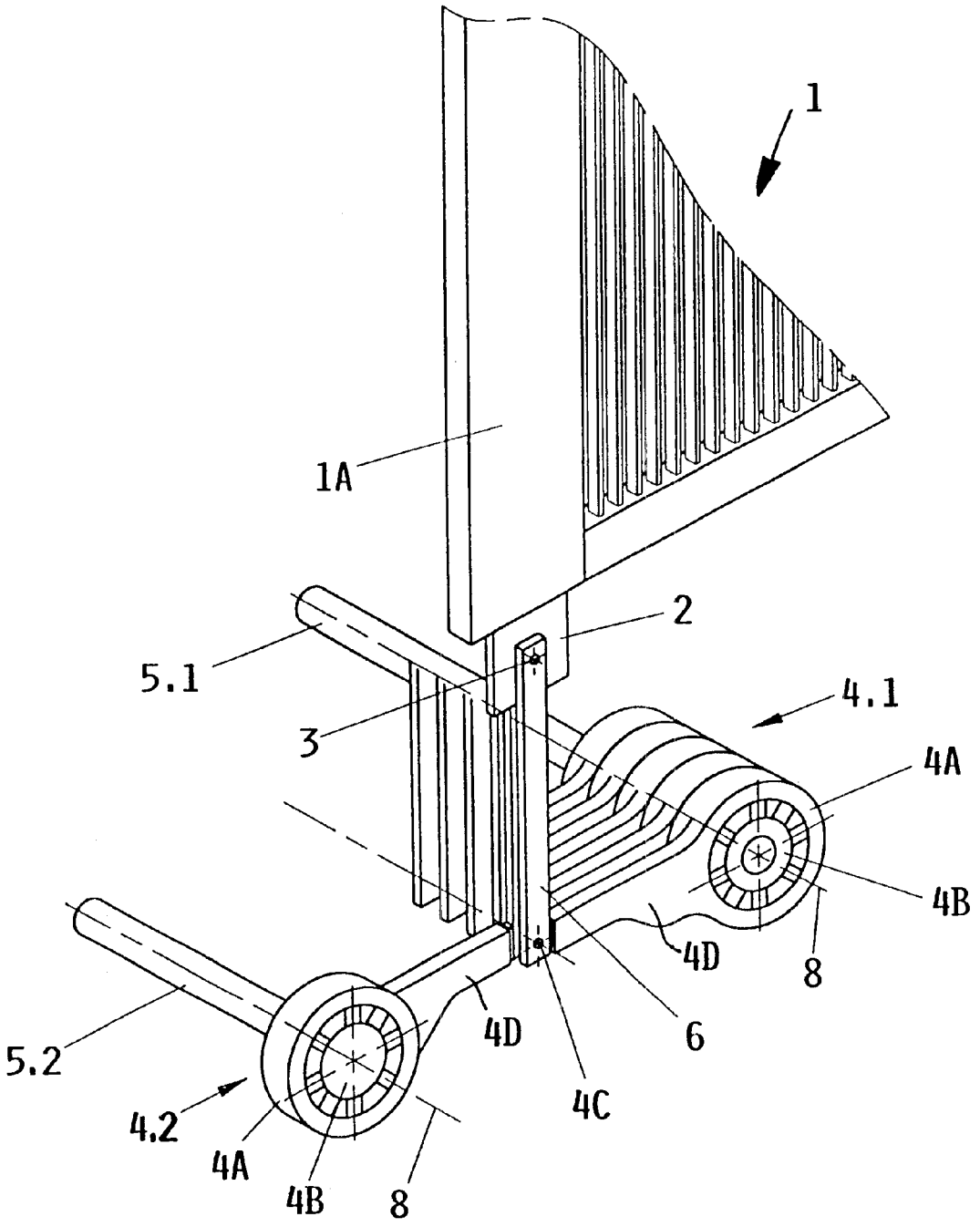
FIG. 3 is a schematic illustration of two electric motor drives having different axle positions, but connected to a common shaft coupling of a heald shaft.
Figure 6:
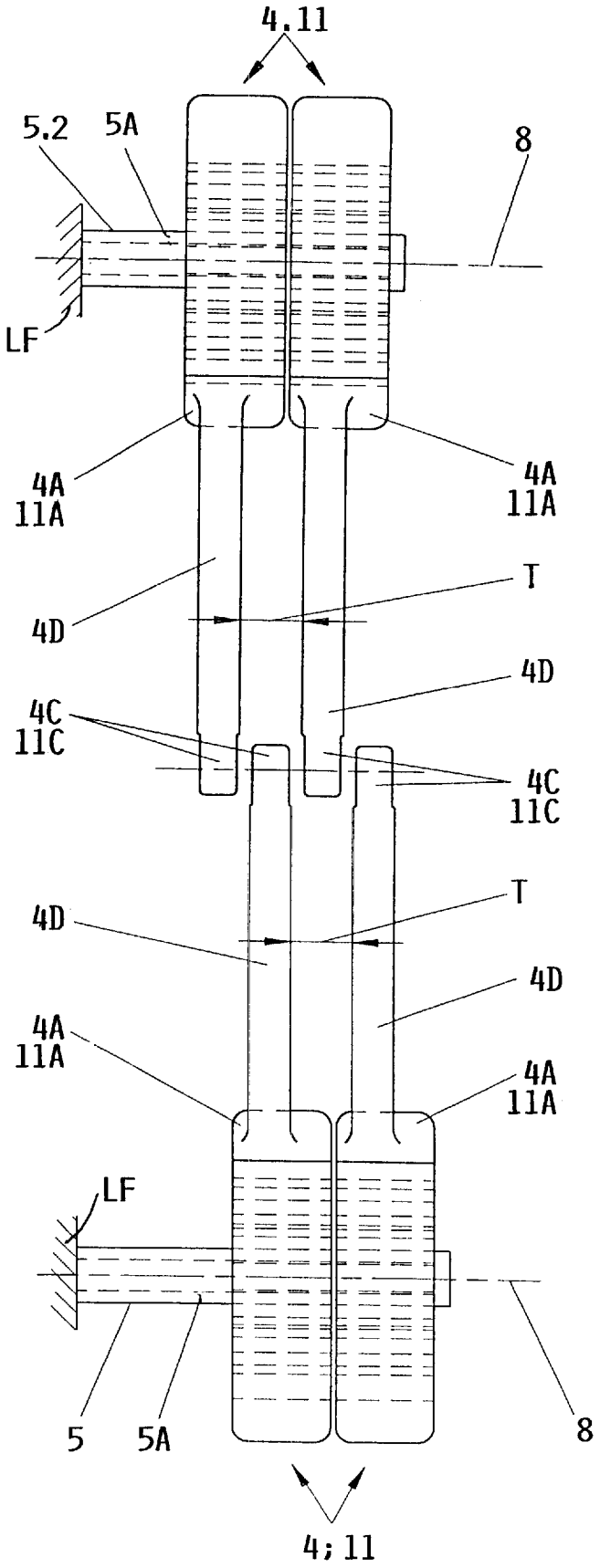
FIG. 6 is a plan view in the direction of the arrow VI—VI in FIG. 7 illustrating a plurality of oscillatory drives provided by electric motors arranged in groups with each group mounted on a respective stationary axle fixed to a loom frame.
Figure 7:
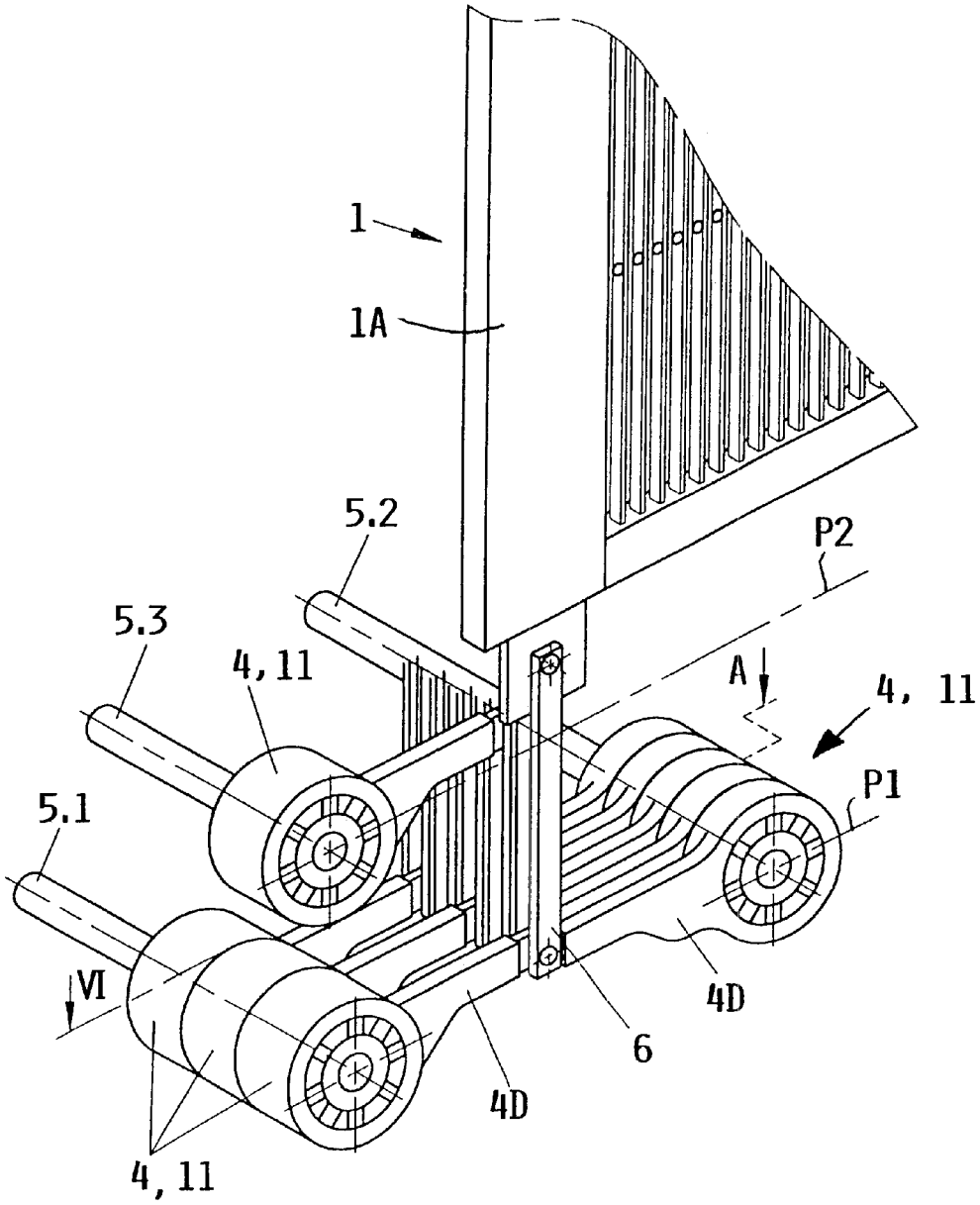
FIG. 7 is a perspective view of three electric motor drives arranged in modular fashion on three different fixed axles.

FIG. 3 shows the arrangement of two groups of modular electric drive motors 4.1 and 4.2 on respective fixed axes 5.1 and 5.2. The multiple arrangement of several groups of modular electric drive motors on respective axles is particularly of importance when a predetermined spacing T between individual heald shafts must be maintained as shown in FIGS. 2 and 6. The spacing T is normally about 12 mm. If the spacing T is less than the axial structural width of any of the motors 4, 4.1, 4.2, arranging the modular electric motors on two axles avoids the problem because such a structure permits an axial structural width of each motor driving a heald shaft coupling 2 through the push-pull rod 6, of for example 24 mm. In an embodiment with three motor carrying axles 5.1, 5.2, and 5.3, as shown in FIG. 7 for example, the axial structural width of each motor 4 may be 36 mm. The axles 5.1, 5.2 and 5.3 are rigidly secured to the loom frame LF and carry the respective stator 4B as will be explained in more detail below. Preferably, the rigid fixed axles 5 are multi-spline axles which carry the fixed motor sections 4B in a modular fashion. More specifically, each motor is a modular unit identical to any other motor modular unit. Further, the axes 5 are provided with an axial bore 5A for passing a coolant through the axis for cooling the respective motors 4, 11 as shown in FIG. 6.

Figure 4:
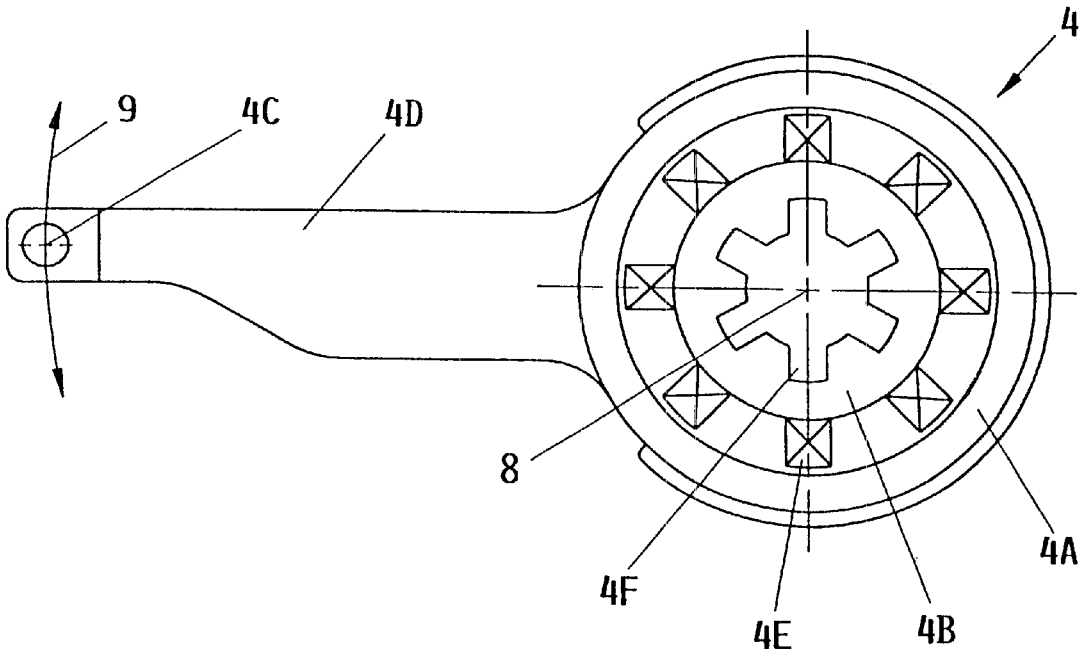
FIG. 4 illustrates schematically an end view of an electric rotation motor for providing an oscillatory heald shaft drive motion.

FIG. 4 illustrates the construction of the above mentioned motors 4, 4.1, 4.2. These motors function in accordance with a conventional direct current motor or an alternating current motor, however, with the difference that the rotor 4A is an external rotor which is capable of responding to a motor control signal from a motor control 7 for oscillating a lever arm 4D back and forth in opposite motion directions or rotation directions according to the double arrow 9. The lever or drive arm 4D is formed as an extension of a movable motor section, such as a rotor 4A. This oscillating back and forth motion of the external rotor 4A is imparted to the lever arm 4D converting the oscillating motion into a tilting back and forth motion. The free end of the lever arm is provided with a pivot or articulation joint 4C to which the push-pull rod 6 is coupled as shown in FIGS. 1, 2, 3 and 7. The fixed motor section or stator 4B of the motor 4, 4.1, 4.2 is provided with a symbolically shown winding or coil 4E which as such is known. Each stator 4B has a central through-hole 4F which has a cross-sectional configuration corresponding to the cross-sectional configuration of the multi-splined axle 5 so that the stator 4B is rigidly secured to the multi-splined shaft 5. Thus, the motor 4, 4.1, 4.2 is constructed as a D.C. motor or as an a.c. motor without a rotating shaft.

Figure 5:
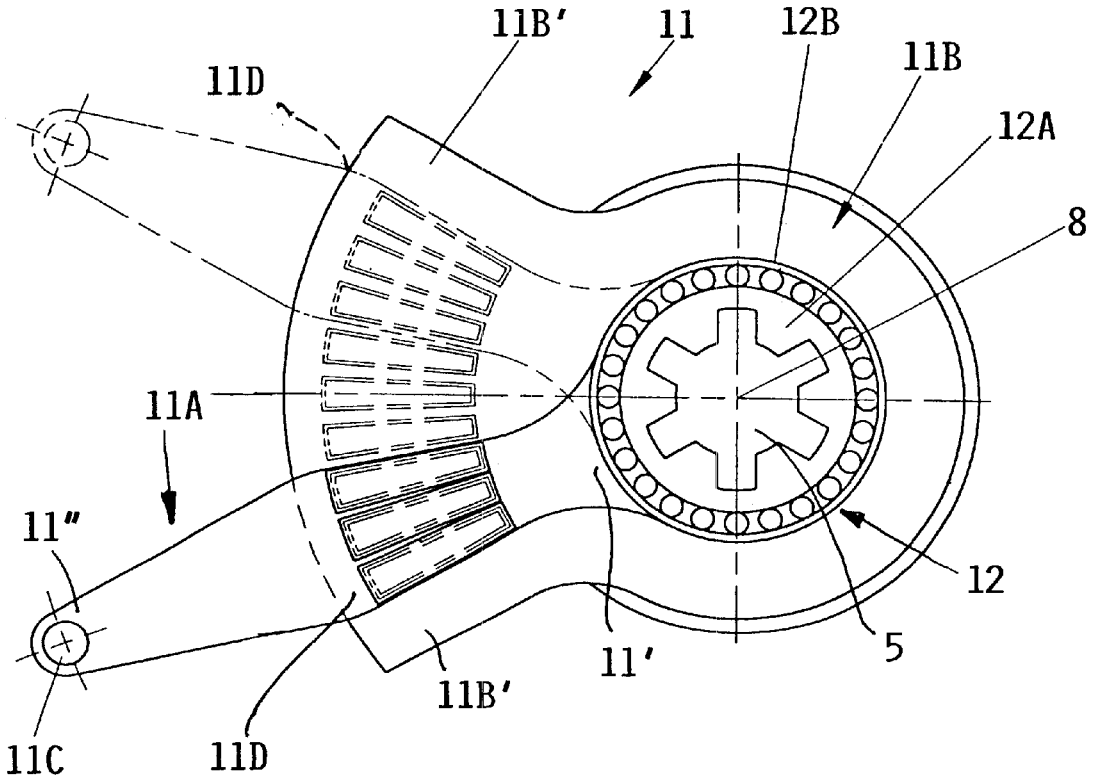
FIG. 5 is a view similar to that of FIG. 4, however showing an electric linear motion motor for providing an oscillatory heald shaft drive motion.

FIG. 5 illustrates another embodiment of a heald shaft drive motor according to the invention constructed as a sector linear motor 11. The basic construction and function of such a sector linear motor 11 is, for example, described in the above mentioned German Patent Publication DE 198 49 728 A1. The movable motor section or armature of the linear motor 11 is constructed as a single drive lever 11A. A radially inner end 11' of the single drive lever 11A is rigidly secured to an outer race 12B of an anti-friction bearing 12. A radially outer end 11" of the drive lever 11A is provided with an articulated coupling 11C for connection to a push-pull rod 6 as shown in FIG. 1. The stationary motor section or stator 11B of the linear motor 11 is rigidly secured to a fixed axle 5 similar to the construction of the above described motor 4. An inner race 12A of the anti-friction bearing 12 is rigidly secured to the shaft 5, preferably through a plurality of splines of the shaft 5 engaging respective grooves in the inner race 12A of the bearing 12. The outer race of the bearing 12 carries the armature formed as the single drive lever 11A. In operation, the single drive lever 11A oscillates back and forth between the full line position shown in the lower lefthand part of FIG. 5 and the dashed line position shown in the upper left portion of FIG. 5. The motion of the coupling 11C up and down between its upper and lower end positions is considered a linear motion for all practical purposes. Extensions 11B' of the stator 11B form stops for the up and down oscillating motion of the drive lever 11A. For this purpose the movable drive lever 11A has a portion 11D between its ends 11' and 11" that contact the extensions 11B' when the lever 11A reaches its end positions.

FIG. 6 shows a plan view in the direction of the arrows VI—VI in FIG. 7, illustrating the rigid motor axles 5.1 and 5.2 located in the same first plane P1 which corresponds to the plane of the drawing. The stators 4B or 11B of the motors 4 or 11 are arranged in modular fashion on each of the fixed axles 5.1 and 5.2 and are rigidly secured to these axles against rotation, for example by the above mentioned spline and groove connections. The above mentioned spacing T between the drive arms 4D or 11D is taken into account in the mounting of these motors on the fixed axles 5.1, 5.2 in such a way that at least two motors 4 and/or 11 are effective on one side of the heald shaft 1 while the same number of motors is effective on the other side of the heald shaft.

FIG. 7 illustrates how the arrangement of the drive motors in, for example two different elevational motor mounting planes P1 and P2 makes it possible to arrange at least two motors 4 or 11 in the first mounting plane P1 and to arrange at least one further motor in the second mounting plane P2 so that these motors can be effective on the same side of the heald shaft 1 for driving the shaft through respective push-pull rods 6.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A drive mechanism for shed forming components of a loom, said drive mechanism comprising at least one modular electric motor (4, 11) for each of said shed forming components, said at least one modular electric motor including a stationary motor section, a movable motor section, and a central axis (8), a motor control (7) electrically connected to said at least one electric motor for oscillating said movable motor section back and forth in opposite motion directions, a push-pull rod (6), a first articulated coupling (3) operatively connecting a first end of said push-pull rod (6) to a respective shed forming component (1) of said shed forming components, a second articulated coupling (4C, 11C) operatively connecting a second end of said push-pull rod (6) to said movable motor section radially outwardly of said central axis (8) and a stationary axle (5) adapted for rigid mounting in a frame of said loom, wherein said stationary motor section of said at least one modular electric motor is rigidly secured to said stationary axle as a modular unit.

2. The drive mechanism of claim 1, wherein said stationary motor section is a central stator of said at least one modular electric motor, wherein said movable motor section is an external rotor of said at least one modular electric motor, and wherein said external rotor comprises a lever arm (4D) having an outer end coupled to said second end of said push-pull rod (6) by said second articulated coupling (4C).

3. The drive mechanism of claim 1, wherein said stationary motor section is a stator of said at least one modular electric motor, wherein said movable motor section is an armature of said at least one modular electric motor, said drive mechanism further comprising a bearing (12) movably mounting said armature to said stationary axle for back and forth movement, and wherein said armature comprises a lever arm (11D) having an inner end (11') rigidly secured to an outer race (12B) of said bearing (12), said lever arm (11D) go having an outer end coupled to said second end of said push-pull rod (6) by said second articulated coupling (11C).

4. The drive mechanism of claim 1, wherein said at least one modular electric motor is one of an A.C. and D.C. motor adapted for reversing a motion direction of said movable motor section in response to a control signal from said motor control (7).

5. The drive mechanism of claim 1, comprising a plurality of modular electric motors and at least two stationary axles (5.1; 5.2) of said stationary axle (5) for supporting said plurality of modular electric motors, and wherein said shed forming components have a spacing (T) between neighboring components that is smaller than an axial structural width of any one of said plurality of said modular electric motors (4, 11).

6. The drive mechanism of claim 5, wherein said at least two stationary axles (5.1, 5.2) are arranged in parallel to each other in a common elevational plane.

7. The drive mechanism of claim 5, comprising at least three stationary axles (5.1, 5.2, 5.3) of which two axles are arranged in a first common plane (P1), wherein a third axle is arranged in a second plane (P2), and wherein all axles extend in parallel to one another.

8. The drive mechanism of claim 1, wherein said stationary axle (5) comprises a plurality of splines spaced by grooves.

9. The drive mechanism of claim 5, wherein each axle (5) carries at least one of said modular electric motors (4, 11) for each of said shed forming components.

10. The drive mechanism of claim 1, wherein said motor control (7) is synchronized for cooperation with a main loom drive.

11. The drive mechanism of claim 1, further comprising loom shed forming components formed as heald shafts.

12. The drive mechanism of claim 1, wherein at least one of said first and second couplings comprises a rapid action coupler.

13. The drive mechanism of claim 1, wherein said rigid axle (5) is positioned in a fixed location vertically spaced below said shed forming components.

14. The drive mechanism of claim 1, wherein said motor control (7) is programmable.

15. The drive mechanism of claim 14, wherein said motor control (7) comprises a memory having stored in said memory at least one motor control program selected from the group consisting of weaving type control programs, heald shaft stroke control programs, shed opening profile control programs and shed closure control programs, and wherein at least one of said control programs takes into account weft yarn parameters.

16. The drive mechanism of claim 14, wherein said fixed axle (5) comprises a longitudinal bore (5A).

17. The drive mechanism of claim 16, wherein said longitudinal bore forms a coolant flow channel for cooling said at least one modular electric motor mounted on said fixed axle.

18. A power loom comprising a loom frame (LF), shed forming components (1) operatively mounted in said loom frame, a main loom drive mounted in said loom frame, a separate drive mechanism in said loom frame for operating said shed forming components, said separate drive mechanism comprising at least one modular electric motor (4, 11) for each of said shed forming components, said at least one modular electric motor including a stationary motor section, a movable motor section, and a central axis (8), a motor control (7) electrically connected to said at least one electric motor for oscillating said movable motor section back and forth in opposite motion directions, a push-pull rod (6), a first articulated coupling (3) operatively connecting a first end of said push-pull rod (6) to a respective shed forming component (1) of said shed forming components, a second articulated coupling (4C, 11C) operatively connecting a second end of said push-pull rod (6) to said movable motor section radially outwardly of said central axis (8), and a stationary axle (5) rigidly mounted in said loom frame, wherein said stationary motor section of said at least one modular electric motor is rigidly secured to said stationary axle as a modular unit.

19. The power loom of claim 18, wherein said motor control (7) is synchronized with said main loom drive.

20. The power loom of claim 18, wherein said motor control (7) comprises a memory having stored in said memory at least one motor control program selected from the group consisting of weaving type control programs, heald shaft stroke control programs, shed opening profile control programs and shed closure control programs, and wherein at least one of said control programs takes into account weft yarn parameters.

* * * * *